United States Patent [19]

Furutsu

[11] Patent Number: 4,553,688

[45] Date of Patent: Nov. 19, 1985

[54] TAG ATTACHING DEVICE

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 579,741

[22] Filed: Feb. 13, 1984

Related U.S. Application Data

[63] Continuation-in-part of Ser. No. 313,714, Oct. 21, 1981, abandoned.

[30] Foreign Application Priority Data

Oct. 24, 1980 [JP] Japan ..... 55-148173

[51] Int. Cl.[4] ..... B25C 7/00; B25C 5/06; B25C 1/00

[52] U.S. Cl. ..... 227/67; 226/67

[58] Field of Search ..... 227/67, 68, 120, 121, 227/127, 128; 226/55-58, 62-64, 67

[56] References Cited

U.S. PATENT DOCUMENTS

| | | | |
|---|---|---|---|
| 3,924,788 | 12/1975 | Furutsu | 227/67 |
| 4,310,962 | 1/1982 | Suzuki | 227/67 X |
| 4,456,162 | 6/1984 | Furutsu | 227/67 |
| 4,461,417 | 7/1984 | Furutsu | 227/67 |
| 4,482,087 | 11/1984 | Furutsu | 227/67 |

*Primary Examiner*—Paul A. Bell

*Attorney, Agent, or Firm*—Blum Kaplan Friedman Silberman & Beran

[57] ABSTRACT

A tag attaching device having a wide application capable of dispensing various tag pin assemblies having different pitches of tag pins. The device has an engaging claw rockably secured to a vertically movable cam plate with a spring mounted between the engaging claw and the main body of the tag attaching device. As the cam plate is lifted, overcoming the force of the spring, the end of the engaging claw is brought to the position between adjacent joint portions of the tag pin assembly and, as the cam plate is lowered by the force of the spring, the tag pin assembly is fed downwardly together with the engaging claw.

3 Claims, 6 Drawing Figures

TAG ATTACHING DEVICE

CROSS-REFERENCE TO RELATED APPLICATION

This application is a continuation-in-part application of co-pending application Ser. No. 313,714, filed Oct. 21, 1981, now abandoned.

BACKGROUND OF THE INVENTION (a) Field of the Invention

The present invention relates to a tag attaching device and, more particularly, to a device for dispensing tag pins made of a plastic for attaching price tags, labels or the like to goods.

(b) Description of the Prior Art

Plastic tag pins have heretofore been used for attaching tags, labels or the like to various goods. The tag pin usually includes a head portion, a lateral bar portion and a filament portion interconnecting the head portion and the lateral bar portion. These portions are integrally molded to provide a substantially H-shaped assembly. To this end, a plurality of tag pins are integrated at a predetermined pitch in the thickness direction to form a comb-like tag pin assembly. Namely, tag pins are connected at their joint portions to a connecting bar in the form of a comb. In other words, each tag pin has a joint portion at which the lateral bar portion thereof is connected to the connecting bar.

Various sizes and shapes of tag pins are commercially available. Naturally, different tag pin assemblies have different pitches of tag pins.

The tag attaching device is a device having a form resembling a pistol and adapted to separate tag pins one by one from the tag pin assembly. The separated tag pin is guided with its lateral bar portion through a hollow needle with a longitudinal slot and penetrates a price tag and an item of goods, thereby to attach the price tag to an article.

The conventional tag attaching device has a feeding device for feeding the tag pin assembly by the action of a gear having gear teeth meshing with the joint portions between each tag pin and the connecting bar, thereby to intermittently feed tag pins successively to the position of the hollow needle. Since this gear has a constant pitch of teeth, this conventional tag attaching device can be applied only to tag pin assemblies having a pitch of tag pins corresponding to the pitch of the feeding gear. This requires users of the tag attaching device to prepare a plurality of tag attaching devices having tag pin feeding gears of different pitches corresponding to pitches of tag pins of different tag pin assemblies.

OBJECTS OF THE INVENTION

Accordingly, an object of the invention is to provide a tag attaching device having a wide application capable of dispensing tag pin assemblies of different pitches of tag pins, provided that the variety of the tag pin pitches is not so large.

Other objects, features and advantages of the invention will become clear from the following description of the preferred embodiments taken in conjunction with the accompanying drawings.

Still other objects and advantages of the invention will in part be obvious and will in part be apparent from the specification.

SUMMARY OF THE INVENTION

To this end, according to the invention, there is provided a tag attaching device comprising a main body, an intermediate lever pivotally secured to the main body, a spring provided between the intermediate lever and the main body so as to project a lever, which is supported on the main body through the intermediate lever, forwardly of a grip portion of the main body, a slider loosely fitted in the intermediate lever and slidably received by the main body, a cam driving member loosely fitted to the intermediate lever and disposed parallel with the slider, a push-out rod fixed to the slider, a hollow needle positioned ahead of the push-out rod and fixed to the main body, a guide groove provided at the rear end of the hollow needle, a cam plate disposed adjacent the guide groove and corresponding to the cam driving member, an engaging claw provided rockably on the cam plate, and a spring disposed between the engaging claw and the main body and adapted to bias the cam plate downwardly.

The invention accordingly comprises the features of construction, combination of elements and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
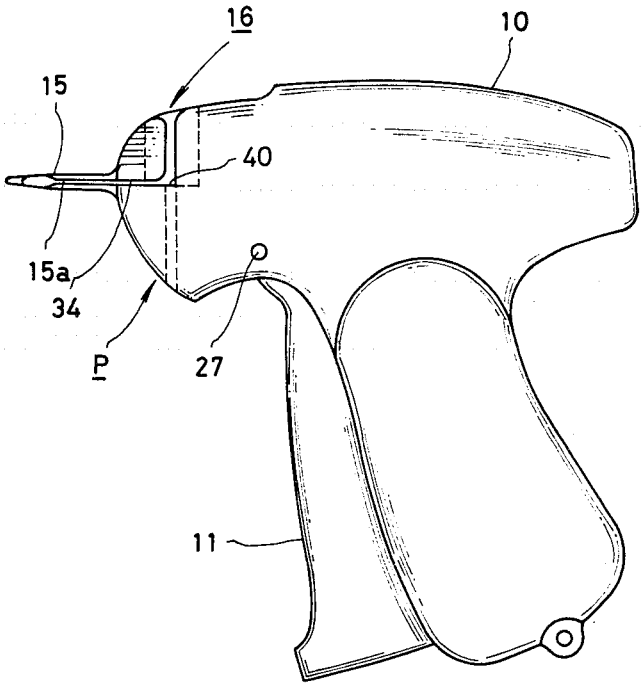
FIG. 1 is a side elevational view of a tag attaching device in accordance with the present invention.

A tag attaching device of the invention is generally indicated at a symbol P. This device has a main body 10 formed of a plastic and has an over-all form resembling a pistol as shown in FIG. 1. The main body 10 consists of two halves 101 and 102, as will be seen from FIG. 2. A lever 11 is pivotally secured to the main body 10 by means of a shaft 27.

Figure 3:
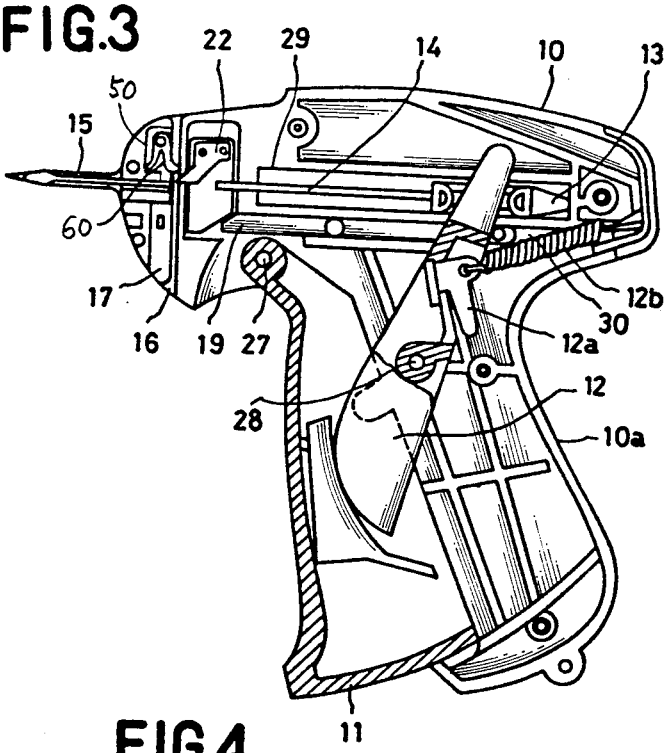
FIG. 3 is a side elevational sectional view of a half portion of the tag attaching device of the present invention depicted in FIG. 1.

As shown in FIG. 3, an intermediate lever 12 is pivotally secured by means of a shaft 28 to a grip portion 10*a*. A spring 12*b* is mounted between a supporting member 12*a* formed on the intermediate lever 12 and a rear end portion of the main body 10. This spring 12*b* normally urges the lever 11 to project forwardly from the grip portion 10*a*, as shown in FIGS. 1 and 3.

A slider 13 is slidably received by a horizontal groove 29 in the main body 10. A driver 14 is fixed to the front portion of the slider 13. A cam driving member 19 is slidably received by a groove 30 formed beneath the groove 29 to extend parallel with the latter.

The upper end portion of the intermediate lever 12 extends through an elongated hole 31 formed in the slider 13. The cam driving member 19 is provided with projections 32 and 33 positioned at the front and the rear sides of the intermediate lever 12.

A hollow needle 15 with a groove is attached to the main body 10 so as to take a position ahead of the driver 14. The hollow needle 15 is replaceable. A guide groove 16 adapted to be loaded with a tag pin assembly T is positioned at the rear side of the hollow needle 15 so as to extend at a right angle to the hollow needle 15.

Figure 2:
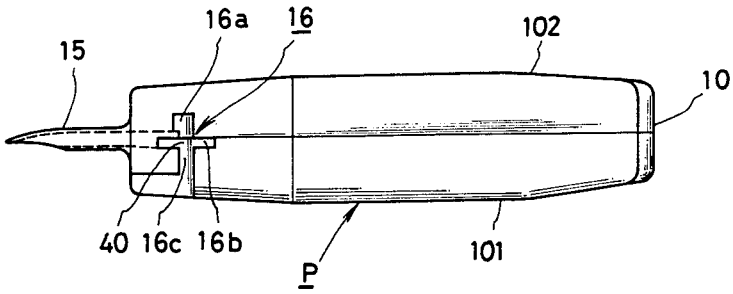
FIG. 2 is a top plan view of the tag attaching device shown in FIG. 1.

As will be seen from FIGS. 1 and 2, the upper half part of the guide groove 16 above the groove 15*a* of the guide needle 15 has a substantially cross-like form.

An explanation will be made hereinbelow as to the construction of the tag pin assembly T. The tag pin assembly has a plurality of tag pins t, each having a head portion 1, a lateral bar portion 2 and a filament portion 3 interconnecting the head portion 1 and lateral bar 2. Tag pins are arranged at a predetermined pitch in the thickness direction of the head portion 1 and are connected to a common connecting bar 5 through joint portions 4.

Referring back to FIGS. 1 and 2, the reference numeral 16*a* designates a groove hole adapted to pass the joint portion 4 and the connecting bar 5 of the tag pin assembly T and extended through the main body 10 in the vertical direction. A groove 16*b* is adapted to receive the lateral bar 2 of the tag pin, while a groove 16*c* is adapted to receive the filament portion 3 of the tag pin. The wall at which the grooves 16*b* and 16*c* terminate constitutes a supporting surface 40 adapted to support the lateral bar 2 of the tag pin t on the tag pin assembly T loaded in the guide groove 16. The groove 15*a* of the guide needle 15 is communicated with the grooves 16*b* and 16*c* of the guide groove 16 through a communication groove 34.

Figure 4:
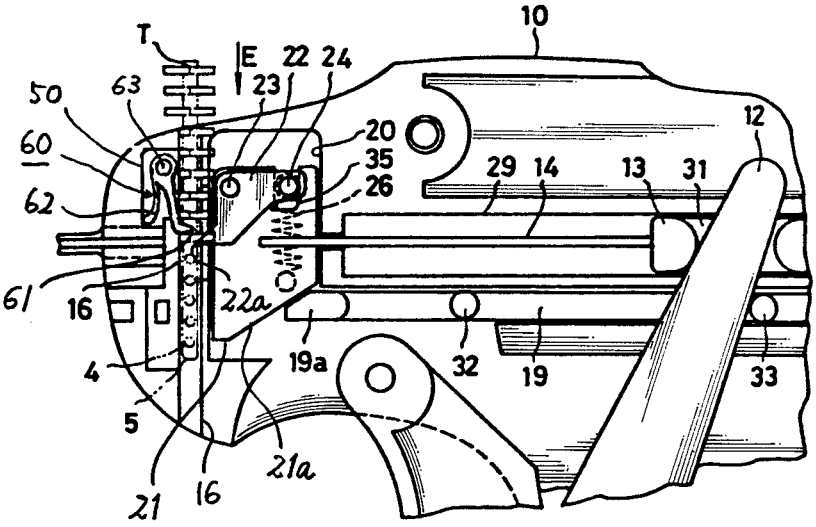
FIGS. 4 and 5 are enlarged views of a portion of the device shown in FIG. 3.
Figure 5:
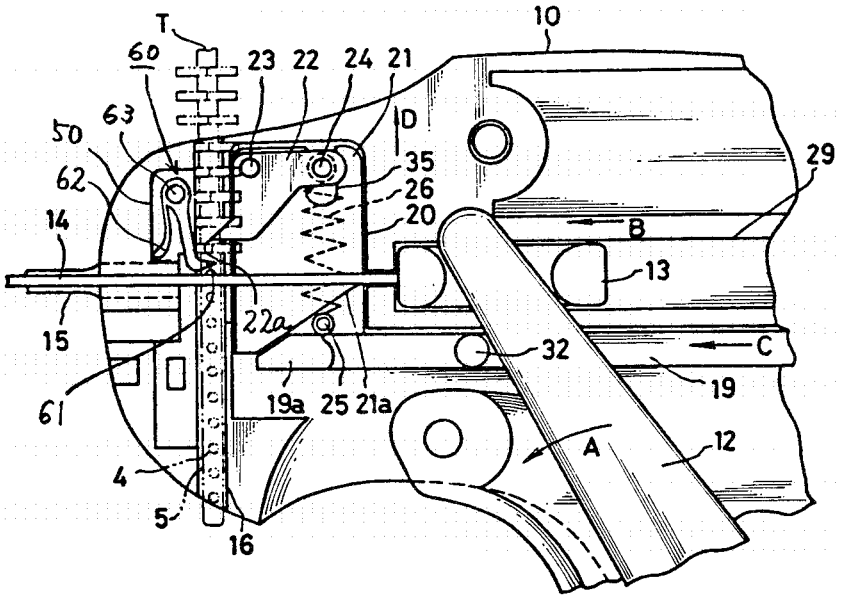
Figure 6:
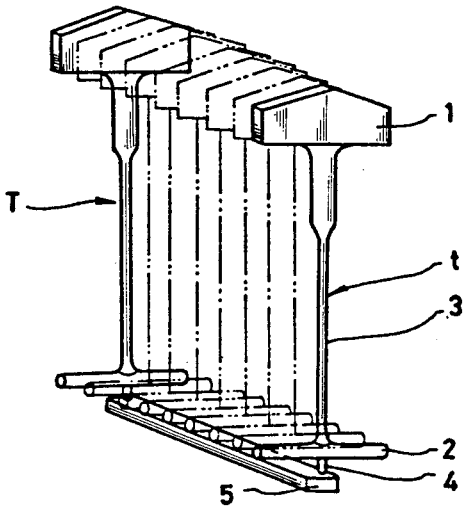
FIG. 6 is a perspective view of a tag pin assembly.

As will be seen from FIGS. 3 through 5, a recess 20 is formed between the guide groove 16 and the slide groove 29 of the slider. A cam plate 21 is disposed in the recess 20 vertically movably. The portion of the cam plate 21 corresponding to the end contacting portion 19*a* of the cam driving member 19 constitutes an inclined cam surface 21*a*.

An engaging claw 22 is rockably secured to the cam plate 21 by means of a shaft 23. A spring 26 is retained at its one end by a shaft 24 provided on the upper rear end of the engaging claw 22 and a pin 25 fixed to the main body 10. The spring 26 normally biases the cam plate 21 downwardly. A groove 35 is formed in the portion of the cam plate 21 corresponding to the shaft 24, so that the cam plate 21 may not hinder the rotation of the engaging claw 22.

A cutter 17 for severing the tag pin t at the joint portion 4 is disposed between the groove 16*a* and the guide needle 15 along the groove 16*a* of the guide groove 16.

The tag attaching device of the invention having the described construction operates in a manner to be explained hereinbelow.

As the lever 11 is depressed into the grip portion 10*a* of the main body 10, the intermediate lever 12 is tilted in the direction of an arrow A as shown in FIG. 5, so that the driver 14 fixed to the slider 13 is moved in the direction of an arrow B. By this movement of the driver 14, the lateral bar 2 of the tag pin positioned behind the hollow needle 15 is forced into the latter. Meanwhile, the joint portion 4 interconnecting the tag pin t and the connecting bar 5 is brought into contact with the cutter 17 so as to be cut by the latter. The driver 14 further pushes the lateral bar 2 to move the latter through the hollow needle 15 and then to force the lateral bar 2 out of the hollow needle 15. The hollow needle 15 is beforehand driven to penetrate a price tag, label or the like and an article so that the lateral bar 2 and a part of the filament portion 3 of the tag pin t are made to pass through the price tag or the like and the article as lateral bar 2 moves through the hollow needle 15.

As the intermediate lever 12 is tilted to a position near the end of its stroke, it comes into engagement with the projection of the cam driving member 19 to move the latter in the direction of an arrow C. In consequence, the end contact portion 19*a* of the cam driving member 19 contacts the cam surface 21*a* of the cam plate 21 to lift the cam plate 21 in the direction of an arrow D, overcoming the force of the spring 26. In order to prevent tag pin assembly T from being pushed in the direction of arrow D as cam plate 21 and engaging claw 22 are lifted, a tag pin retention means 60 may be provided to ensure that such upward movement does not occur.

Tag pin retention means or stopper 60 includes a ratchet 61, a pushing blade 62 and a shaft 63. Stopper 60 is mounted in a recess 50 in main body 10. Ratchet 61 engages joint portion 4 of tag pin assembly T to prevent movement of tag pin assembly T in the direction of arrow D. In the width direction of main body 10, ratchet 61 is spaced from engaging claw 22 so as not to interfere with the action of claw 22.

The engaging claw 22 is lifted as a result of the upward movement of the cam plate 21 and will pivot or rock against the bias of spring 26 as it passes over joint portion 4 to prevent pushing tag pin assembly T in an upward direction, since assembly T is prevented from moving upward by the action of stopper 60. In consequence, the engaging claw 22 is pulled by the spring 26 to position its end 22*a* between the adjacent joint portions 4 and 4 of the tag pin assembly T.

As the lever 11 is released from the gripping force after driving the tag pin t into the article as stated above, the spring 12*b* provided between the intermediate lever 12 and the main body 10 acts to reset the intermediate lever 12 as shown in FIGS. 3 and 4, thereby to reset the slider 13 and the cam driving member 19.

As the cam driving member 19 is reset to the initial position, the cam plate 21 is made to descend in the recess 20 by the action of the spring 26 and, accordingly, the engaging claw 22 is lowered. During this movement of the engaging claw 22, the end portion 22*a* of the engaging claw 22 engages with the joint portion 4 of the tag pin assembly T to depress the latter. The downward movement of the engaging claw 22 and the cam plate 21 is stopped when the lateral bar 2 of the tag pin t comes to be supported by the supporting surface 40 of the main body to take a position aligned with the inlet of the groove of the hollow needle 15.

As has been described, in the tag attaching device of the invention, an engaging claw is rockably secured to a vertically movable cam plate, with a spring provided between the engaging claw and the main body. In operation, as the cam plate is lifted, overcoming the force of the spring, the end portion of the engaging claw comes between adjacent joint portions of the tag pin assembly and, as the cam plate is lowered by the force of the spring, the tag pin assembly is lowered together with the engaging claw to bring the lateral bar of a tag pin into alignment with the inlet of the groove of the hollow needle. The tag attaching device of the present invention, therefore, can dispense different tag pin assemblies having different pitches of tag pins. This conveniently relieves a user of the device from the burden of preparing a plurality of tag attaching devices for different tag pin assemblies.

It will thus be seen that the objects set forth above, and those made apparent from the preceding description, are efficiently attained, and since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A tag attaching device for dispensing tag pins joined to a connecting bar from a tag pin assembly, each said tag pin having a head portion, a lateral bar portion, a filament portion coupling said head portion of said lateral bar portion and a joint portion coupling said tag pin to said connecting bar, comprising:

a main body;

an intermediate lever pivotally secured to said main body;

a first spring mounted between said intermediate lever and said main body and adapted to project a lever, which is pivotally secured to said main body through said intermediate lever, forwardly from a grip portion of said main body;

a slider loosely fitted to said intermediate lever and slidably mounted in said main body;

a cam driving member loosely fitted to said intermediate lever and disposed substantially parallel with said slider;

a driver fixed to said slider;

a hollow needle positioned ahead of a said driver and fixed to said main body;

a guide groove formed at the rear side of said hollow needle;

a cam plate disposed adjacent said guide groove so as to correspond to said cam driving member;

an engaging claw rockably mounted on said cam plate, said engaging claw having an end which engages intermediate adjacent joint portions of said tag pin assembly; and a second spring mounted between said engaging claw and said main body and adapted to bias said cam plate downwardly and bias said engaging claw toward said hollow needle and said tag pin assembly.

2. A tag attaching device as claimed in claim 1, wherein the portion of said cam plate corresponding to said cam driving member is shaped into a tapered cam surface.

3. A tag attaching device as claimed in claim 1, wherein said cam plate is provided with a groove at its portion corresponding to a spring retaining pin fixed to said engaging claw.

* * * * *